United States Patent [19]

Stout

[11] 4,258,844

[45] Mar. 31, 1981

[54] ARTICLE CARRIER

[75] Inventor: James T. Stout, Acworth, Ga.

[73] Assignee: The Mead Corporation, Dayton, Ohio

[21] Appl. No.: 166,800

[22] Filed: Jul. 8, 1980

Related U.S. Application Data

[63] Continuation of Ser. No. 22,684, Mar. 21, 1979, abandoned.

[51] Int. Cl.[3] ..... B65D 75/00

[52] U.S. Cl. ..... 206/188; 229/28 BC; 229/52 BC; 229/DIG. 9

[58] Field of Search ..... 206/172, 180, 181, 185–189, 206/191, 428; 229/28 BG, 52 BG, 28 R, DIG. 9

[56] References Cited

U.S. PATENT DOCUMENTS

| | | | |
|---|---|---|---|
| 775,048 | 11/1904 | Stevenson | 229/23 A |
| 2,098,818 | 11/1937 | Andrews | 229/23 A |
| 3,412,894 | 11/1968 | Wood | 206/188 |
| 3,917,059 | 11/1975 | Wood | 206/191 |
| 3,917,060 | 11/1975 | Wood | 206/191 |
| 4,000,814 | 1/1977 | Stout | 206/187 |

*Primary Examiner*—Joseph Man-Fu Moy
*Attorney, Agent, or Firm*—Rodgers & Rodgers

[57] ABSTRACT

An article carrier formed from a unitary blank comprises spaced side and end walls foldably joined along adjacent edges, medial partition structure joined to the end walls and extending medially inward of the carrier, handle structure secured to the medial partition structure, a bottom panel secured to the lower edge of each side wall, an auxiliary bottom panel foldably joined to an end edge of the bottom panel and disposed on top thereof, and the auxiliary bottom panel being wider than the bottom panel.

3 Claims, 9 Drawing Figures

ARTICLE CARRIER

This application is a continuation of application Ser. No. 22,684, filed Mar. 21, 1979 now abandoned.

TECHNICAL FIELD

This invention relates to article carriers with improved bottom structure and which are nestable with an adjacent carrier for the purpose of providing economy of material.

BACKGROUND ART

Article carriers are known which have a double thickness of paperboard material between critical points of article contact. An example of this style of carrier is disclosed and claimed in U.S. Pat. No. 4,187,944 issued Feb. 12, 1980. A related carrier is disclosed and claimed in U.S. Pat. No. 3,412,894.

DISCLOSURE OF INVENTION

An article carrier formed from a unitary blank comprises a pair of spaced side walls, end wall panels foldably joined respectively to the ends of the side walls, medial partition structure foldably joined to the medial edges of the end wall panels, handle structure secured to the medial partition structure and extending upwardly therefrom, a bottom panel foldably joined to the lower edge of one side wall, an auxiliary bottom panel foldably joined to an end edge of the bottom panel and disposed in overlapping face contacting relation therewith, and the auxiliary bottom panel being secured to the lower edge of the other side wall.

BEST MODE FOR CARRYING OUT THE INVENTION

Figure 2:
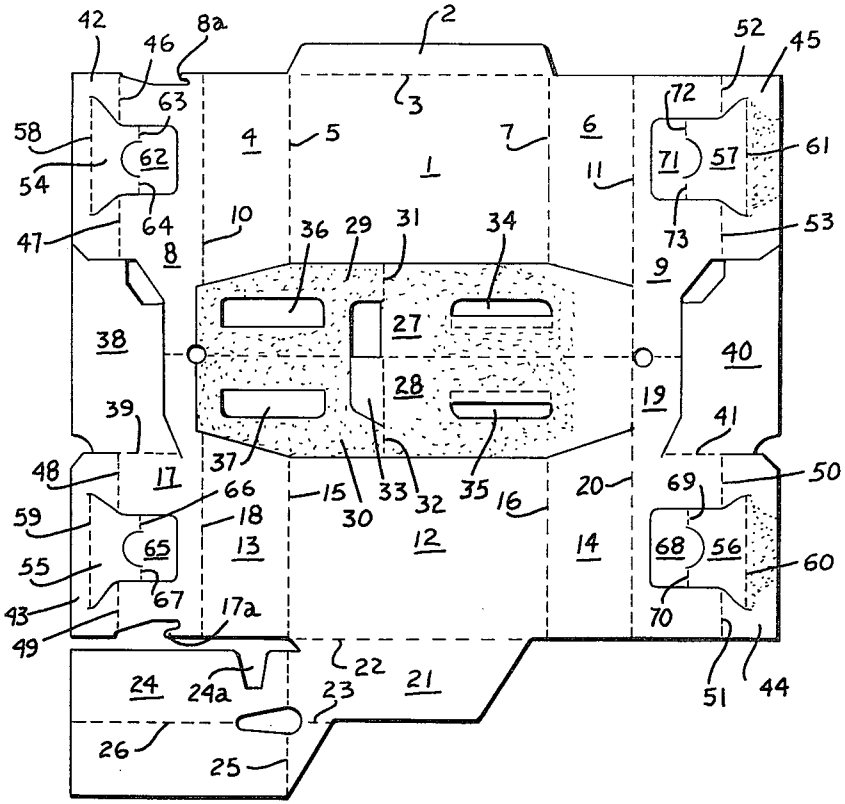
FIG. 2 is a plan view of a blank from which the carrier shown in FIG. 1 is formed.

In the drawings the numeral 1 designates a side wall of the carrier to the bottom edge of which a glue flap 2 is foldably joined along fold line 3. End wall panel 4 is foldably joined to an end edge of side wall 1 along fold line 5 while end wall panel 6 is foldably joined to the opposite end edge of side wall 1 along fold line 7. Medial panels 8 and 9 are foldably joined to end wall panels 4 and 6 respectively along fold lines 10 and 11. Medial panel 8 is provided with locking notch 8*a*.

The other side of the blank is similar to that just described and includes side wall 12 to the side edges of which end wall panels 13 and 14 are foldably joined respectively along fold lines 15 and 16. Medial panel 17 is foldably joined to end wall panel 13 along fold line 18 and medial panel 19 is foldably joined to end wall panel 14 along fold line 20. Medial panel 17 is provided with locking notch 17*a*.

According to this invention in one form, the bottom wall is formed of a multiple layer of paperboard material. Specifically bottom panel 21 is foldably joined to the bottom edge of side wall 12 along fold line 22 and is provided with medial fold line 23. In addition auxiliary bottom panel 24 is joined to bottom panel 21 along fold line 25 and is provided with medial fold line 26 and blank manipulation notch 24*a*. Blank manipulation notch 24*a* allows access to an edge of the blank by a corresponding machine element in order to facilitate formation of the carrier.

Handle structure for the carrier includes handle panels 27 and 28 which are foldably joined respectively to medial panels 9 and 19 along fold lines 11 and 20. In order to provide additional strength in the area of the handle, reinforcing panels 29 and 30 are provided and are joined respectively to handle panels 27 and 28 along fold lines 31 and 32. Also auxiliary flap 33 is foldably joined to handle panel 28 along fold line 32. Hand gripping apertures 34 and 35 are formed respectively in handle panels 27 and 28 and, similarly, hand gripping apertures 36 and 37 are formed respectively in reinforcing panels 29 and 30.

To provide medial article separation, medial partition structure at one end of the blank comprises medial panel 8 and 17 together with medial partition panel 38 which is foldably joined to medial panel 17 along fold line 39. Likewise at the right hand end of the blank, as viewed in FIG. 2, the medial partition structure comprises medial panels 9 and 19 and medial partition panel 40 which is foldably joined to medial panel 19 along fold line 41.

In order to provide individual article receiving cells, transverse partition structure is provided and includes transverse partition panels 42, 43, 44, and 45. Transverse partition panel 42 is foldably joined along fold lines 46 and 47 to medial panel 8 and, similarly, transverse partition panel 43 is foldably joined to medial panel 17 along fold lines 48 and 49. Also transverse partition panel 44 is foldably joined to medial panel 19 along fold lines 50 and 51 and transverse partition panel 45 is foldably joined to medial panel 9 along fold lines 52 and 53.

Additional transverse partition structure is provided in the form of transverse partition panels 54, 55, 56, and 57 which are foldably joined respectively to transverse partition panels 42, 43, 44, and 45 along fold lines 58, 59, 60, and 61.

In addition anchoring tab 62 is foldably joined to transverse partition panel 54 along fold lines 63 and 64 and, likewise, anchoring tab 65 is foldably joined to transverse partition panel 55 along fold lines 66 and 67. Similarly anchoring tab 68 is foldably joined to transverse partition panel 56 along fold lines 69 and 70 and, likewise, anchoring tab 71 is foldably joined to transverse partition panel 57 along fold lines 72 and 73.

In order to form the completed carrier from the blank shown in FIG. 2, an application of glue is first made to the inner surfaces of handle panels 27 and 28 and to reinforcing panels 29 and 30 as shown by stippling in FIG. 2. Thereafter reinforcing panels 29 and 30 are elevated and folded over to the right along fold lines 31 and 32 respectively into positions of flat face contacting relation with the inner surfaces of handle panels 27 and 28 respectively.

Figure 3:
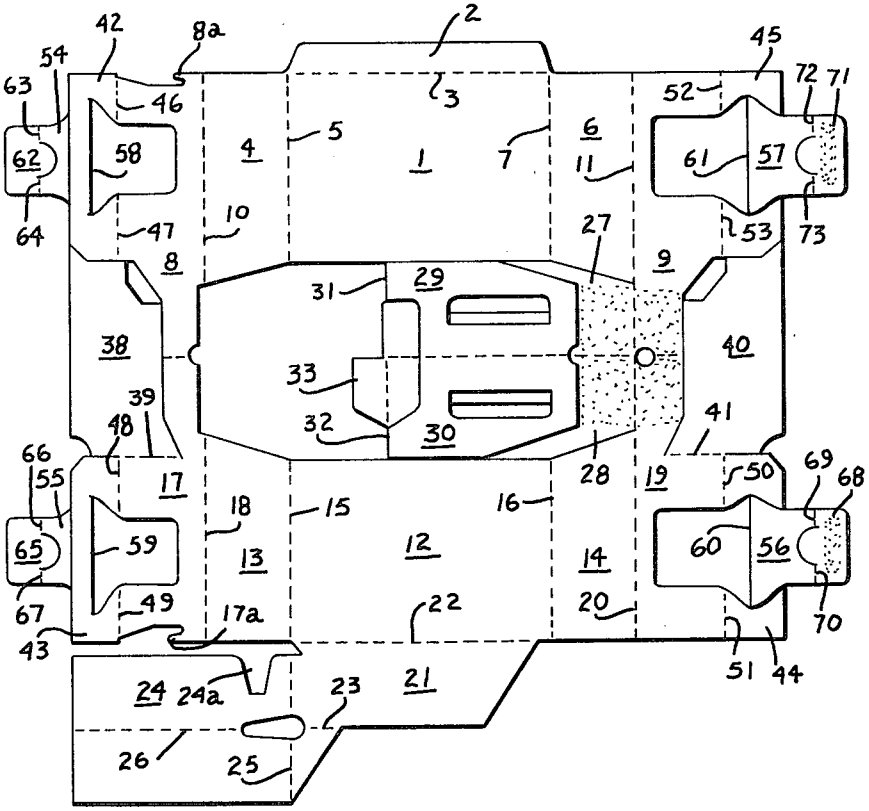

Following this, transverse partition panels 54 and 55 together with anchoring tabs 62 and 65 are folded downwardly out of the plane of the blank, as viewed in FIG. 2, and rotated toward the left 180° along fold lines 58 and 59 respectively to occupy the positions shown in FIG. 3. Then an application of glue is made to transverse partition panels 44 and 45 as shown by stippling in FIG. 2. Generally simultaneously with the folding of transverse partition panels 54 and 55, transverse partition panels 56 and 57 and their associated anchoring tabs 68 and 71 are folded upwardly 180° toward the right and out of the plane of the blank along fold lines 60 and 61 respectively. The inner surfaces of transverse partition panels 56 and 57 are adhered respectively to the inner surfaces of transverse partition panels 44 and 45. The carrier then appears as shown in FIG. 3.

Figure 4:
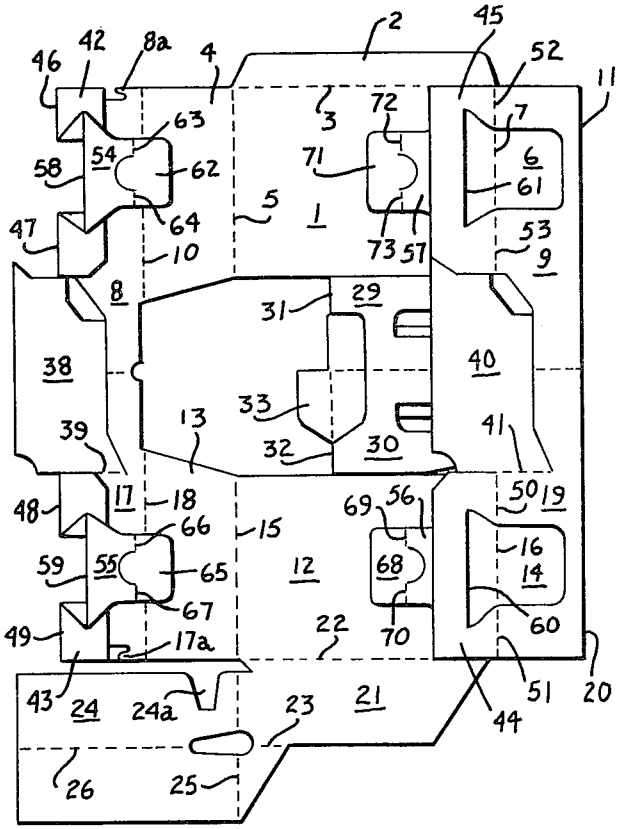
FIGS. 3, 4, 5, 6, and 7 depict intermediate stages through which the blank of FIG. 2 is manipulated and glued in order to form a complete and collapsed carrier as shown in FIG. 8.

Following this operation, an application of glue is made to anchoring tabs 68 and 71, handle panels 27 and 28, and medial panels 9 and 19 as indicated by stippling in FIG. 3. Then the transverse partition structure on the right hand side of the blank as viewed in FIG. 3 together with the medial partition structure comprising medial panels 9 and 19 and medial partition panel 40 are elevated and folded toward the left along fold lines 11 and 20. By this operation anchoring tabs 68 and 71 are adhered to the inner surfaces of side walls 12 and 1 respectively as shown in FIG. 4. In addition the transverse partition structure disposed on the left hand side of the blank, as viewed in FIG. 3, together with the associated anchoring tabs are folded over to the right along fold lines 46, 47, 48, and 49 into the positions depicted in FIG. 4. Then medial partition panel 40 is folded up and over along fold line 41 to occupy the position shown in FIG. 5.

Figure 6:
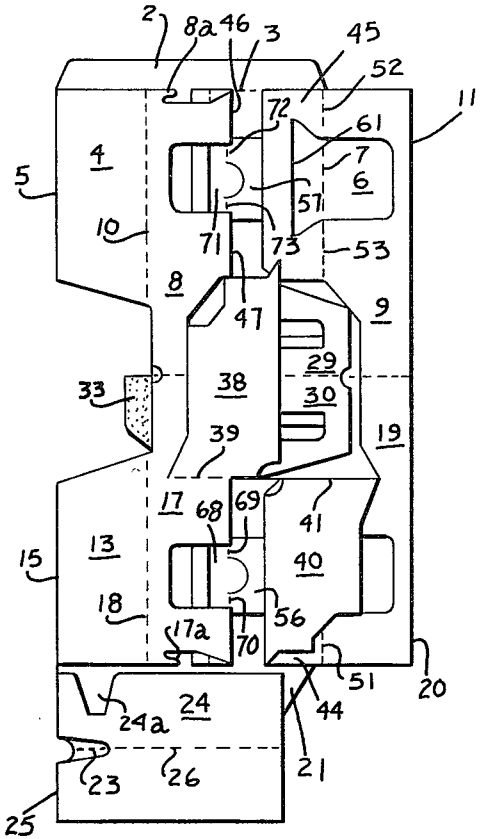
Figure 5:
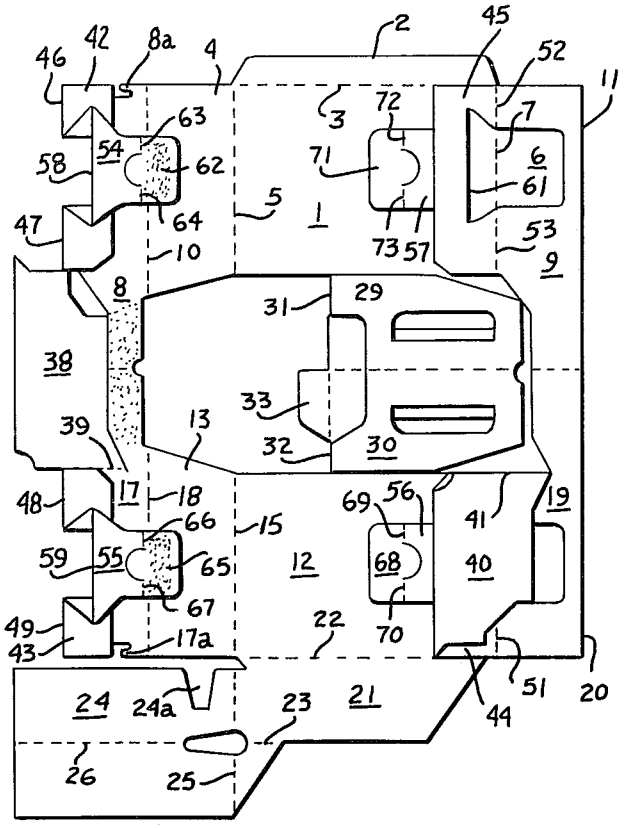

An application of glue is then made to medial panels 8 and 17 and anchoring tabs 62 and 65 as shown by stippling in FIG. 5. Thereafter end wall panels 4 and 13, medial panels 8 and 17, medial partition panel 38, auxiliary bottom panel 24, and the associated transverse partition structure on the left hand side of the blank as viewed in FIG. 5 are elevated and folded toward the right along fold lines 5, 15, and 25 to occupy the positions shown in FIG. 6. By this operation anchoring tabs 62 and 65 are adhered to the inner surfaces of side walls 1 and 12 respectively. Also glue is applied to auxiliary tab 33 as indicated by stippling in FIG. 6. Then auxiliary tab 33 is folded over along fold line 32 and adhered to a portion of the inner surface of medial panel 17. Then medial partition panel 38 is elevated and folded downwardly along fold line 39 to occupy the position shown in FIG. 7.

Figure 7:
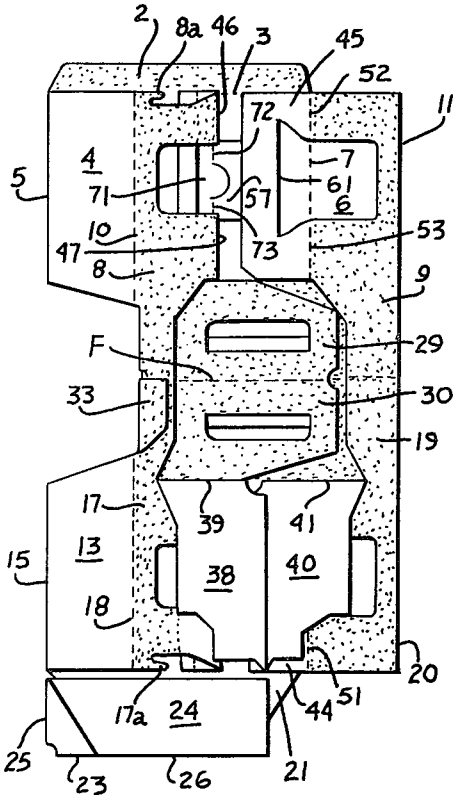

To complete formation of the carrier, an application of glue is made thereto as shown by stippling in FIG. 7. More specifically glue is applied to medial panels 8, 9, 17, and 19, reinforcing panels 29 and 30, auxiliary panels 33, and glue flap 2. Bottom panel 21 and auxiliary bottom panel 24 are then folded respectively along fold lines 23 and 26. Following this the portion of the blank which is disposed above the fold line F as viewed in FIG. 7 is elevated and folded into the position depicted in FIG. 8 which represents the completed carrier in collapsed condition.

Figure 1:
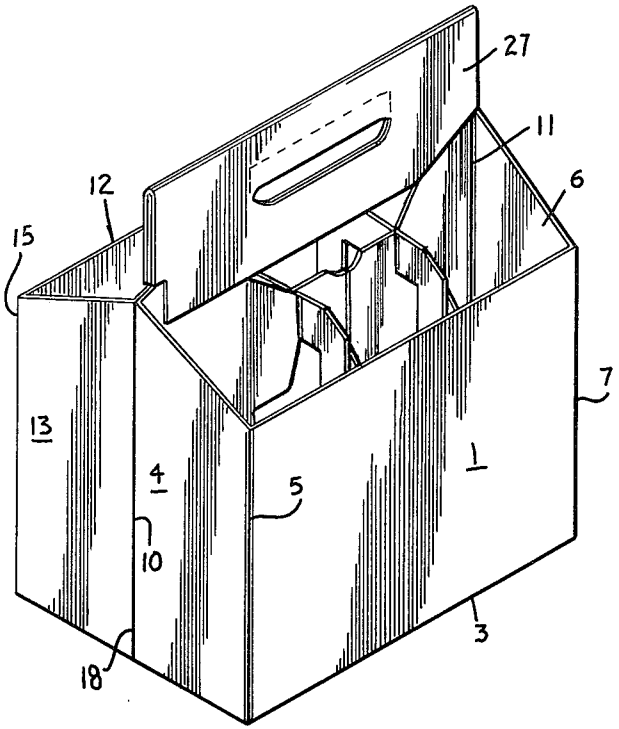
FIG. 1 is an isometric view of a set-up carrier formed according to this invention.
Figure 8:
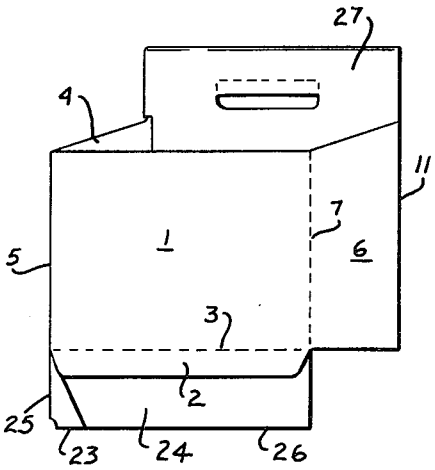

In order to set up the carrier from its collapsed condition as shown in FIG. 8 into the condition shown in FIG. 1, it is simply necessary to secure the side walls 1 and 12 against movement toward the left and to apply a force toward the left to the medial edges of end wall panels 6 and 14. This expands the carrier and moves the side walls apart. Simultaneously the bottom panel 21 and auxiliary bottom panel 24 each fold into a flat plane. The carrier is then maintained in setup condition as shown in FIG. 1, by cooperation between the locking notches **8*a* and 17*a* and one end of bottom panel 21**.

Therefore by this invention an article carrier is provided which has a reinforced bottom structure of double panel construction. This improvement provides necessary added strength and reduces the tendency of the carrier to fail, especially along fold lines 3 and 22. In addition since auxiliary bottom panel 24 is wider than bottom panel 21, and since it is disposed on top of bottom panel 21, auxiliary bottom panel 24 and glue flap 2 are glued together on the untreated sides of the paperboard material. Naturally this feature enhances the adhesion quality between these two elements because the glue is allowed thoroughly to soak into the paperboard. Also since fold line 25 extends across the entire width of the carrier, a substantial increase in structural reinforcement is achieved between bottom panel 21 and auxiliary bottom panel 24.

Figure 9:
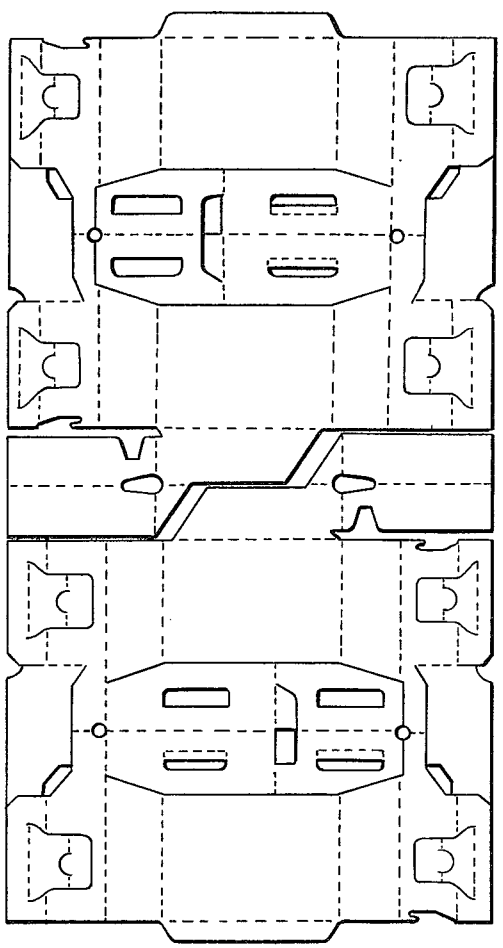
FIG. 9 shows a pair of blanks disposed in a nested relationship.

With reference to FIG. 9, the carrier blank can be nested with an adjacent blank to afford economy of material. In the typical nesting arrangement, adjacent carrier bottom walls are disposed in a side by side arrangement. This causes the corresponding elements of each blank to offset from each other. Therefore a strip of unused paperboard material is formed along one edge of each carrier blank which ultimately must be discarded. According to this invention, the irregular configuration of the bottom wall allows direct nesting of the bottom wall of one blank with the bottom wall of an adjacent blank. In this nesting configuration, the basic elements of the carrier are in longitudinal alignment, as shown in FIG. 9. Therefore by this invention, a maximum amount of paperboard material is utilized without the normal waste.

INDUSTRIAL APPLICABILITY

By this invention an article carrier is provided which has double thickness medial and transverse partitions at all points of article contact and has a bottom wall of double panel construction which is not prone to failure at the various points of critical stress.

I claim:

1. An article carrier comprising a pair of side walls disposed in parallel spaced relation to each other, end wall panels foldably joined respectively to the ends of said side walls and extending inwardly therefrom, medial partition structure foldably joined to the medial edges of said end wall panels and extending medially inward therefrom, handle structure secured to said medial partition structure and extending upwardly therefrom, a bottom panel foldably joined to the lower edge of one of said side walls, and characterized in that an auxiliary bottom panel is joined to an end edge of said bottom panel along a fold line substantially equal in length to the width of the carrier and is disposed in overlapping face contacting relation therewith, said auxiliary bottom panel being wider than said bottom panel throughout the length of said bottom panel except for the portion thereof which is immediately adjacent said fold line and said auxiliary bottom panel being substantially equal in length to said bottom panel and being secured to the lower edge of the other of said side wall and in that a glue flap is foldably joined to the lower edge of the other of said side walls and glued to said auxiliary bottom panel so as to provide a double thickness of material over substantially the entire carrier bottom.

2. An article carrier according to claim 1 and further characterized in that a blank manipulation notch is formed in said auxiliary bottom panel.

3. An article carrier according to claim 1 and further characterized in that said auxiliary bottom panel is disposed in face contacting relation with the top surface of said bottom panel.

* * * * *